US012239895B2

(12) United States Patent
Libke

(10) Patent No.: US 12,239,895 B2
(45) Date of Patent: Mar. 4, 2025

(54) MULTI-OPERATIVE FIELDING AID ACCESSORY

(71) Applicant: Jerahmie Libke, Henderson, NV (US)

(72) Inventor: Jerahmie Libke, Henderson, NV (US)

( * ) Notice: Subject to any disclaimer, the term of this patent is extended or adjusted under 35 U.S.C. 154(b) by 542 days.

(21) Appl. No.: 17/694,641

(22) Filed: Mar. 14, 2022

(65) Prior Publication Data

US 2022/0203194 A1 Jun. 30, 2022

Related U.S. Application Data

(63) Continuation-in-part of application No. 16/744,221, filed on Jan. 16, 2020, now abandoned, which is a (Continued)

(51) Int. Cl.
*A63B 69/36* (2006.01)
*A63B 69/00* (2006.01)
(Continued)

(52) U.S. Cl.
CPC ..... *A63B 69/0059* (2013.01); *A63B 69/0002* (2013.01); *A63B 71/143* (2013.01);
(Continued)

(58) Field of Classification Search
CPC ..... A63B 69/0059; A63B 69/0002; A63B 71/143; A63B 2069/0011; A63B 2102/18; A63B 2102/182; A63B 2209/10
(Continued)

(56) References Cited

U.S. PATENT DOCUMENTS 1,418,637 A 6/1922 Swift
1,469,315 A 10/1923 Hansard
(Continued)

FOREIGN PATENT DOCUMENTS

KR 100833990 B1 6/2008
WO 1989007403 A1 8/1989
(Continued)

OTHER PUBLICATIONS

"Libke Pro—Learn how to field like the pro's do!" by Libke Pro, Published Online [Jan. 4, 2017] https://www.youtube.com/watch?v=8Cp_apFspkY.
(Continued)

*Primary Examiner* — Nini F Legesse
(74) *Attorney, Agent, or Firm* — LEGALFORCE RAPC WORLDWIDE

(57) ABSTRACT

A method includes anchoring a loop strap and a hook strap at a first surface of a rectangular arcuate panel proximate a first end of the first surface, providing a retaining element anchored to the rectangular arcuate panel, with the retaining element forming a loop, and providing an extension strap anchored to the rectangular arcuate panel proximate the retaining element to form a fielding aid accessory. The method also includes wrappably attaching the anchored first hook strap with the anchored first loop strap around a forearm of an athlete and securely positioning fingers of a hand thereof by way of the loop of the retaining element such that the forearm contacts a second surface of the rectangular arcuate panel. The fielding aid accessory is configured to be used by the athlete in two modes of operation based on a configuration of coupling of the extension strap.

20 Claims, 10 Drawing Sheets

Related U.S. Application Data continuation-in-part of application No. 16/273,170, filed on Feb. 12, 2019, now abandoned, which is a continuation-in-part of application No. 15/356,554, filed on Nov. 19, 2016, now abandoned.

(51) Int. Cl.
*A63B 71/14* (2006.01)
*A63B 102/18* (2015.01)

(52) U.S. Cl.
CPC ... *A63B 2069/0011* (2013.01); *A63B 2102/18* (2015.10); *A63B 2102/182* (2015.10); *A63B 2209/10* (2013.01)

(58) Field of Classification Search
USPC ..... 473/205, 213, 409, 458
See application file for complete search history.

(56) References Cited

U.S. PATENT DOCUMENTS

| | | | | |
|---|---|---|---|---|
| 2,924,458 | A | 2/1960 | Barry | |
| 3,217,332 | A | 11/1965 | Gross | |
| 3,423,095 | A | 1/1969 | Cox | |
| 3,640,273 | A | 2/1972 | Ray | |
| 3,700,245 | A * | 10/1972 | Nannini | A63B 69/0059 473/213 |
| 4,176,840 | A | 12/1979 | Lanning | |
| 4,183,098 | A | 1/1980 | Knowles, Jr. | |
| D266,345 | S | 9/1982 | Bigham et al. | |
| D270,556 | S | 9/1983 | Kneisley | |
| 4,451,044 | A | 5/1984 | Elliott, Jr. | |
| 4,541,127 | A | 9/1985 | Gould | |
| 4,637,610 | A | 1/1987 | Carr | |
| 4,911,728 | A | 3/1990 | Rigel | |
| 4,937,882 | A | 7/1990 | Hayes | |
| D333,520 | S | 2/1993 | Mann | |
| 5,214,798 | A * | 6/1993 | McLaughlin | A63B 71/143 2/160 |
| D360,467 | S | 7/1995 | Sydor et al. | |
| 5,456,650 | A | 10/1995 | Williams, Jr. et al. | |
| 5,476,439 | A | 12/1995 | Robinson | |
| 5,499,820 | A | 3/1996 | Albertsson | |
| 5,526,531 | A | 6/1996 | Olson et al. | |
| 5,593,353 | A | 1/1997 | Kramer | |
| 5,600,849 | A | 2/1997 | Hu | |
| 5,634,854 | A | 6/1997 | Albertsson | |
| 5,651,743 | A | 7/1997 | Stephan et al. | |
| 5,671,477 | A | 9/1997 | Aoki | |
| 5,778,449 | A | 7/1998 | Oetting et al. | |
| 5,845,643 | A | 12/1998 | Vergano et al. | |
| 5,850,633 | A | 12/1998 | Lovin | |
| 5,976,036 | A | 11/1999 | Jackson | |
| 6,199,208 | B1 | 3/2001 | Torbett | |
| D451,248 | S | 11/2001 | Jack | |
| D456,081 | S | 4/2002 | Bell et al. | |
| D461,901 | S | 8/2002 | Rodgers | |
| D468,019 | S | 12/2002 | Slautterback | |
| D468,434 | S | 1/2003 | Slaughterback | |
| 6,553,997 | B2 | 4/2003 | Illas | |
| D486,610 | S | 2/2004 | Alivo, Jr. | |
| 6,716,185 | B1 | 4/2004 | Rieger | |
| 6,773,410 | B2 | 8/2004 | Varn | |
| 6,785,909 | B1 | 9/2004 | Li | |
| D580,555 | S | 11/2008 | Lin et al. | |
| D590,105 | S | 4/2009 | Pohorelec | |
| 7,686,740 | B1 | 3/2010 | Chang | |
| 7,897,857 | B2 | 3/2011 | Lockwood | |
| 8,142,299 | B1 | 3/2012 | Shah | |
| 8,251,842 | B2 | 8/2012 | Heflin, Sr. | |
| 8,652,080 | B2 | 2/2014 | Benz et al. | |
| 8,727,914 | B2 | 5/2014 | Sells | |
| 8,801,531 | B2 | 8/2014 | Buchanan et al. | |
| 8,926,455 | B2 | 1/2015 | Drozjock et al. | |
| 9,233,290 | B2 | 1/2016 | Woody | |
| D769,538 | S | 10/2016 | Gutman | |
| 9,795,852 | B2 | 10/2017 | Shew et al. | |
| D848,005 | S | 5/2019 | Adams | |
| 10,639,531 | B1 | 5/2020 | McCarter | |
| D911,623 | S | 2/2021 | Libke | |
| 2005/0081273 | A1 | 4/2005 | Ota | |
| 2005/0234374 | A1 | 10/2005 | Grim et al. | |
| 2007/0157364 | A1 | 7/2007 | Comstock et al. | |
| 2012/0100939 | A1 | 4/2012 | Townsend | |
| 2015/0202514 | A1 | 7/2015 | Ervin et al. | |
| 2016/0045801 | A1 | 2/2016 | Malkin | |
| 2018/0140920 | A1* | 5/2018 | Libke | A63B 71/143 |
| 2019/0192941 | A1* | 6/2019 | Libke | A63B 69/0002 |
| 2020/0147468 | A1* | 5/2020 | Libke | A63B 71/143 |
| 2021/0146212 | A1 | 5/2021 | Coppaken et al. | |

FOREIGN PATENT DOCUMENTS

| | | | |
|---|---|---|---|
| WO | 1992008379 | A1 | 5/1992 |
| WO | 1997034665 | A1 | 9/1997 |
| WO | 2000035390 | A1 | 6/2000 |

OTHER PUBLICATIONS

"Libke Pro—How to Field Like a Professional Baseball Player" by Libke Pro, Published Online [Jun. 16, 2017] https://www.youtube.com/watch?v=twclc5KNMDg.

"How to put the Libke Pro Fielder on" by Libke Pro, Published Online [Feb. 6, 2017] https://www.youtube.com/watch?v=HZqgVy32-21.

"How to Field a Baseball" by Libke Pro, by Pro Baseball Insider, Found Online [May 10, 2022] https://probaseballinsider.com/baseball-instruction/how-to-field-a-baseball-like-a-pro/.

* cited by examiner

MULTI-OPERATIVE FIELDING AID ACCESSORY

CLAIM OF PRIORITY

This application is a Continuation-in-Part application of co-pending U.S. patent application Ser. No. 16/744,221 titled MULTI-OPERATIVE FIELDING AID ACCESSORY filed on Jan. 16, 2020, which is a Continuation-in-Part application of U.S. patent application Ser. No. 16/273,170 titled FIELDING AID ACCESSORY TO SECURE ON A FOREARM OF A PLAYER TO ENSURE OPTIMAL ARM POSITION filed on Feb. 12, 2019, which is a Continuation-in-Part application of U.S. patent application Ser. No. 15/356,554 titled BASEBALL OR SOFTBALL FIELDING AID ACCESSORY filed on Nov. 19, 2016. The contents of all of the aforementioned applications are incorporated by reference herein in entirety thereof.

FIELD OF TECHNOLOGY

This disclosure relates generally to a sports accessory and, more particularly, to a method, and/or an apparatus of a multi-operative fielding aid accessory.

BACKGROUND

A field game (e.g., baseball, softball, cricket) may be a team sport in which two opposing teams compete with each other in a confined physical area. The field game might consist of two teams, with each team rotating between a batting side and a fielding side. The batting side may use a bat to hit a ball to score runs. The fielding side may need to catch the ball while playing the field game to prevent runs from being scored.

The players (e.g., shortstop) of fielding team may wear a fielding glove (e.g., baseball glove, a softball glove, a mitt) while fielding and/or catching the ball. The fielding glove may be a covering for a hand worn for protection against injury, cold, and/or dirt. The fielding glove may have separate parts for each finger and a thumb. Training players to properly use the fielding glove may require observation, repetition, and/or coaching. It may be expensive and impractical to watch each time a player attempts to catch the ball using the fielding glove. Even when the player is coached in proper use of the fielding glove, proper positioning of an arm and/or hand may be a skill that a player may need to develop on their own because it may involve human biomechanics of arm and hand coordination. A team that has poor fielding capability will often give away runs in a game because of fielding errors. The loss of these runs caused by errors might make the difference between losing and winning a game.

SUMMARY

Disclosed are methods and/or an apparatus of a multi-operative fielding aid accessory.

In one aspect, a method includes anchoring a loop strap and a hook strap at a first location on a first surface of a rectangular arcuate panel proximate a first end of the rectangular arcuate panel, with the first surface having a first width, and anchoring a retaining element proximate a second end of the rectangular arcuate panel, with the retaining element extending from lateral and opposite edges of the rectangular arcuate panel proximate the second end to form a loop around a second surface of the rectangular arcuate panel. The second surface is below the first surface on an opposite side of the first surface. The method also includes anchoring an extension strap to the rectangular arcuate panel at an edge of the rectangular panel proximate the retaining element and perpendicular to the lateral and the opposite edges of the rectangular arcuate panel such that the anchored extension strap, the rectangular arcuate panel, the anchored retaining element, the anchored loop strap and the anchored hook strap form a fielding aid accessory, with the extension strap having a second width thereof equal to at least 70% of the first width of the first surface.

Further, the method includes wrappably attaching the anchored hook strap with the anchored loop strap around a forearm of an athlete and securely positioning fingers of a hand of the athlete associated with the forearm by way of the loop of the retaining element such that the forearm contacts the second surface of the rectangular arcuate panel and the retaining element is contactably disposed on a surface of the hand of the athlete that also corresponds to that of a palm section of the hand, and conformably coupling the extension strap across the first surface without wrapping the extension strap around any element external to the fielding aid accessory by extending the extension strap over the first surface to a second location on the first surface proximate the first location of the anchoring of the loop strap and the hook strap to enable the athlete to use the fielding aid accessory in a first mode of operation.

Still further, the method includes providing the rectangular arcuate panel with an angled shape such that, in the first mode of operation, a portion of the hand of the athlete contacting the rectangular arcuate panel is at an angle about a wrist of the athlete with respect to the forearm thereof contacting the rectangular arcuate panel in conformance with the angled shape, and removing the conformable coupling of the extension strap across the first surface in the first mode of operation followed by wrapping the extension strap around a wrist strap of a fielding glove and removably coupling the extension strap wrapped around the wrist strap of the fielding glove back across the first surface to the second location on the first surface to enable the athlete to use the fielding aid accessory in a second mode of operation. The second mode of operation involves the fielding glove being affixed to the fielding aid accessory by way of the removable coupling.

In another aspect, a method includes anchoring a loop strap and a hook strap at a first location on a first surface of a rectangular arcuate panel proximate a first end of the rectangular arcuate panel, with the first surface having a first width and the rectangular arcuate panel being a rigid frame covered at least partially with a protective membrane, and anchoring a retaining element proximate a second end of the rectangular arcuate panel, with the retaining element extending from lateral and opposite edges of the rectangular arcuate panel proximate the second end to form a loop around a second surface of the rectangular arcuate panel. The second surface is below the first surface on an opposite side of the first surface. The method also includes anchoring an extension strap to the rectangular arcuate panel at an edge of the rectangular panel proximate the retaining element and perpendicular to the lateral and the opposite edges of the rectangular arcuate panel such that the anchored extension strap, the rectangular arcuate panel, the anchored retaining element, the anchored loop strap and the anchored hook strap form a fielding aid accessory, with the extension strap having a second width thereof equal to at least 70% of the first width of the first surface.

Further, the method includes wrappably attaching the anchored hook strap with the anchored loop strap around a forearm of an athlete and securely positioning fingers of a hand of the athlete associated with the forearm by way of the loop of the retaining element such that the forearm contacts the second surface of the rectangular arcuate panel and the retaining element is contactably disposed on a surface of the hand of the athlete that also corresponds to that of a palm section of the hand, and conformably coupling the extension strap across the first surface without wrapping the extension strap around any element external to the fielding aid accessory by extending the extension strap over the first surface to a second location on the first surface proximate the first location of the anchoring of the loop strap and the hook strap to enable the athlete to use the fielding aid accessory in a first mode of operation.

Still further, the method includes providing the rectangular arcuate panel with an angled shape such that, in the first mode of operation, a portion of the hand of the athlete contacting the rectangular arcuate panel is at an angle about a wrist of the athlete with respect to the forearm thereof contacting the rectangular arcuate panel in conformance with the angled shape, and removing the conformable coupling of the extension strap across the first surface in the first mode of operation followed by wrapping the extension strap around a wrist strap of a fielding glove and removably coupling the extension strap wrapped around the wrist strap of the fielding glove back across the first surface to the second location on the first surface to enable the athlete to use the fielding aid accessory in a second mode of operation. The second mode of operation involves the fielding glove being affixed to the fielding aid accessory by way of the removable coupling.

In yet another aspect, a method includes forming a fielding aid accessory by anchoring a loop strap and a hook strap at a first location on a first surface of a rectangular arcuate panel proximate a first end of the rectangular arcuate panel, with the first surface having a first width, anchoring a retaining element proximate a second end of the rectangular arcuate panel, with the retaining element extending from lateral and opposite edges of the rectangular arcuate panel proximate the second end to form a loop around a second surface of the rectangular arcuate panel and the second surface being below the first surface on an opposite side of the first surface, and anchoring an extension strap to the rectangular arcuate panel at an edge of the rectangular panel proximate the retaining element and perpendicular to the lateral and the opposite edges of the rectangular arcuate panel, with the extension strap having a second width thereof equal to at least 70% of the first width of the first surface.

The method also includes wrappably attaching the anchored hook strap with the anchored loop strap around a forearm of an athlete and securely positioning fingers of a hand of the athlete associated with the forearm by way of the loop of the retaining element such that the forearm contacts the second surface of the rectangular arcuate panel and the retaining element is contactably disposed on a surface of the hand of the athlete that also corresponds to that of a palm section of the hand, and, by the athlete, utilizing the formed fielding aid accessory in a first mode of operation by conformably coupling the extension strap across the first surface without wrapping the extension strap around any element external to the fielding aid accessory by extending the extension strap over the first surface to a second location on the first surface proximate the first location of the anchoring of the loop strap and the hook strap.

Further, the method includes providing the rectangular arcuate panel with an angled shape such that, in the first mode of operation, a portion of the hand of the athlete contacting the rectangular arcuate panel is at an angle about a wrist of the athlete with respect to the forearm thereof contacting the rectangular arcuate panel in conformance with the angled shape, and, by the athlete, utilizing the formed fielding aid accessory in a second mode of operation by wrapping the extension strap around a wrist strap of a fielding glove, and removably coupling the extension strap wrapped around the wrist strap of the fielding glove back across the first surface to the second location on the first surface. The second mode of operation involves the fielding glove being affixed to the fielding aid accessory by way of the removable coupling.

Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Figure 1A:
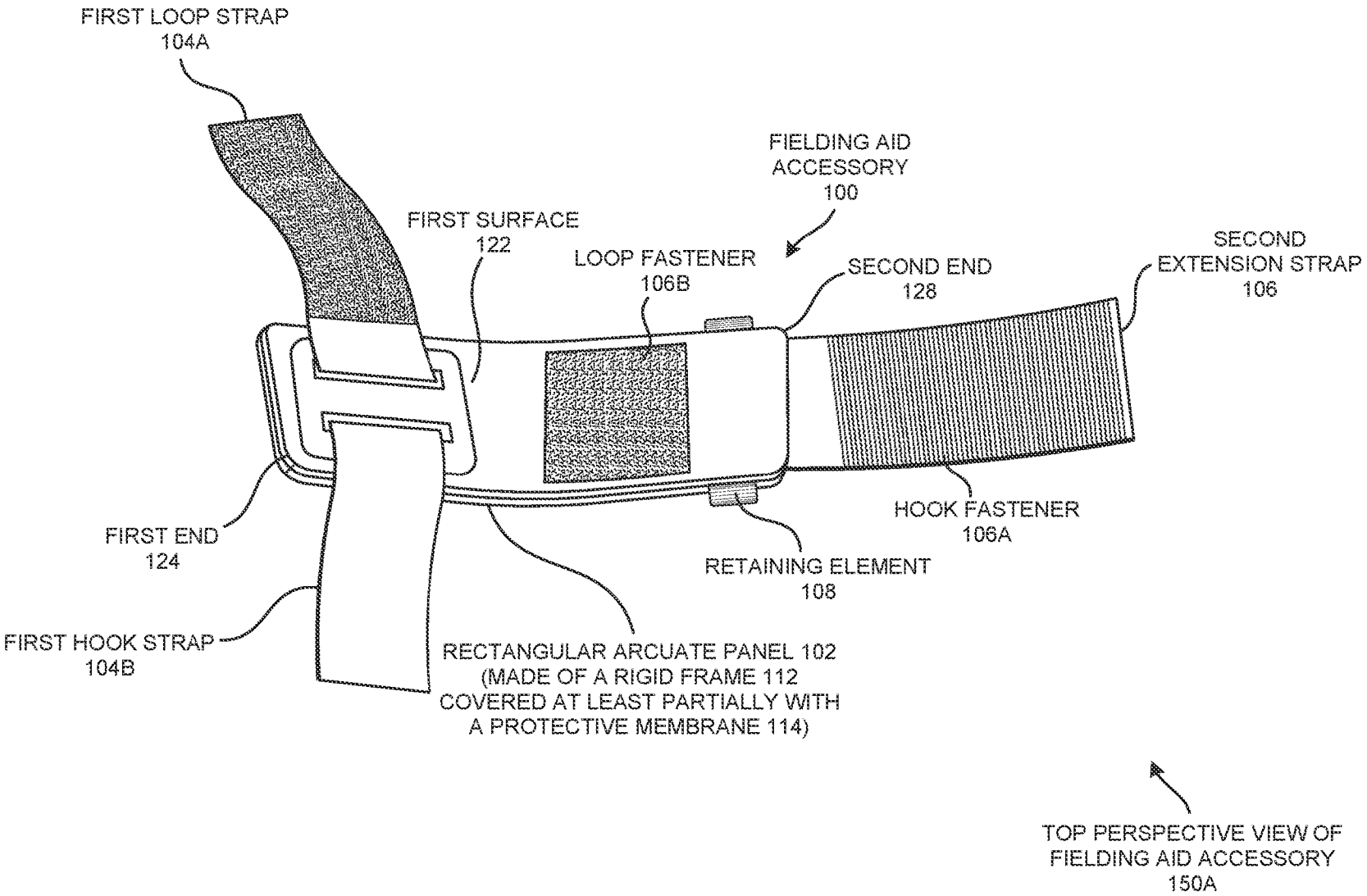
FIG. 1A is a top perspective view of a fielding aid accessory illustrating a first loop strap, a first hook strap and a second extension strap of a rectangular arcuate panel for securing the rectangular arcuate panel onto a forearm of an athlete to securely affix a fielding glove, according to one or more embodiments.

Other features of the present embodiments will be apparent from the accompanying drawings and from the detailed description that follows.

DETAILED DESCRIPTION

Example embodiments, as described below, may be used to provide methods and/or an apparatus of a multi-operative fielding aid accessory.

In one embodiment, a fielding aid accessory 100 includes a rectangular arcuate panel 102, a first loop strap 104A, a first hook strap 104B, a second extension strap 106, and a retaining element 108. The rectangular arcuate panel 102 may be made of a rigid frame 112 covered at least partially with a protective membrane 114; in one or more embodiments, said protective membrane 114 may be at least partially made of leather material. The first loop strap 104A and the first hook strap 104B are anchored at a center of a first surface 122 of the rectangular arcuate panel 102 proximate a first end 124 of first surface 122. The first hook strap 104B wrappably attaches with the first loop strap 104A to secure the fielding aid accessory 100 onto a forearm 200 of an athlete 500. The second extension strap 106 is anchored to the rectangular arcuate panel 102 at a second end 128 of first surface 122 (or, a second surface 126 of rectangular arcuate panel 102 on an opposite side of first surface 122). When fielding aid accessory 100 is secured onto forearm 200, forearm 200 contacts second surface 126 of rectangular arcuate panel 102, with second surface 126 being below first surface 122 on an opposite side of first surface 122.

In addition, the second extension strap 106 extends over and through a center opening 304 of a fielding glove 300 to securely affix the fielding glove 300 to the rectangular arcuate panel 102. The second extension strap 106 wraps around a wrist strap 306 of the fielding glove 300. A hook fastener 106A of the second extension strap 106 secures a loop fastener 106B positioned on an interior body of the rectangular arcuate panel 102. The retaining element 108 is anchored at a bottom side of the rectangular arcuate panel 102 to enable the athlete to securely position the fingers of the athlete 500. The retaining element 108 encompasses the fingers of the hand when the fielding glove 300 is securely affixed to the rectangular arcuate panel 102, according to one embodiment.

The fielding aid accessory 100 may hold the fielding aid accessory 100 in a front-facing angle to enable a mitt section 302 of the fielding glove 500 to encompass a ball object 502. The fielding glove 300 may be extended open through extension of fingers of a hand of the athlete 500 when the ball object 502 is thrown to the athlete 500. The fielding aid accessory 100 may ensure an appropriate fielding posture of the athlete 500 wearing the fielding aid accessory 100. The athlete 500 wearing the fielding aid accessory 100 may hold the fielding aid accessory 100 in the front-facing angle of the mitt section 302 of the fielding glove 300 when the ball object 502 is thrown to the athlete 500, according to one embodiment.

Further, the fielding aid accessory 100 may restrain the fielding glove 300 from contracting. The fielding glove 300 may remain open through extension of fingers to create more room for the ball object 502 to be captured by the athlete 500 in the mitt section 302 of the fielding glove 300 when the ball object 502 is thrown to the athlete 500, according to one embodiment.

The rectangular arcuate panel 102 of the fielding aid accessory 100 may be designed to hold the fielding glove 300 in a proper glove presentation to appropriately field the ball object 502. The first strap and is a hook (e.g., first hook strap 104B) and/or a loop (e.g., first loop strap 104A) fastener. The second extension strap 106 may be a hook (e.g., first loop strap 104A) and/or loop (e.g., loop fastener 106B) fasteners. The retaining element 108 may be an elastic cord, according to one embodiment.

In another embodiment, a fielding aid equipment (e.g., fielding aid accessory 100) includes a rigid rectangular center segment (e.g., rigid frame 112 of rectangular arcuate panel 102) with a protective membrane 114, a first loop extension (e.g., first loop strap 104A), a first hook extension (e.g., first hook strap 104B), and a retaining element 108. The rigid rectangular center segment (e.g., rigid frame 112 of rectangular arcuate panel 102) may be enfolded by a protective membrane 114 (e.g., leather material).

The first loop extension (e.g., first loop strap 104A) and the first hook extension (e.g., first hook strap 104B) are anchored at a center of a first surface 122 of rectangular arcuate panel 102 proximate a first end 124 of first surface 122. A hook fastener of the first hook extension (e.g., first hook strap 104B) is positioned at a bottom side of rectangular arcuate panel 102 to wrappably attach with the first loop extension (e.g., first loop strap 104A).

In addition, the hook fastener of the first hook extension (e.g., first hook strap 104B) attaches with the first loop extension (e.g., first loop strap 104A) to secure the fielding aid equipment (e.g., fielding aid accessory 100) directly onto a forearm 200 of an athlete 500. When fielding aid accessory 100 is secured onto forearm 200, forearm 200 contacts a second surface 126 of rectangular arcuate panel 102, with second surface 126 being below first surface 122 on an opposite side of first surface 122. The retaining element 108 is anchored at the bottom side of the rectangular arcuate panel 102. The retaining element 108 has a space to allow the athlete 500 to securely position the fingers of a hand by encompassing the fingers inside the retaining element 108, according to one embodiment.

The fielding aid equipment (e.g., fielding aid accessory 100) may hold the fielding aid equipment (e.g., fielding aid accessory 100) in a front-facing angle to enable a palm section 202 of the athlete 500 to encompass a ball object 502. The palm section 202 may be extended open through extension of fingers of the hand of the athlete 500 when the ball object 502 is thrown to the athlete 500, according to one embodiment.

The fielding aid equipment (e.g., fielding aid accessory 100) may ensure an appropriate fielding posture of the athlete 500 wearing the fielding aid equipment (e.g., fielding aid accessory 100). The athlete 500 wearing the fielding aid equipment (e.g., fielding aid accessory 100) may hold the fielding aid equipment (e.g., fielding aid accessory 100) in the front-facing angle of the palm section 202 of the hand when the ball object 502 is thrown to the athlete 500, according to one embodiment.

The fielding aid equipment (e.g., fielding aid accessory 100) may restrain the palm section 202 from contracting. The palm section 202 may remain open through extension of fingers to create more room for the ball object 502 to be captured by the athlete 500 in the palm section 202 when the ball object 502 is thrown to the athlete 500, according to one embodiment.

The rigid rectangular center segment (e.g., rigid frame 112 of rectangular arcuate panel 102) of the fielding aid equipment (e.g., fielding aid accessory 100) may be designed to position the forearm 200 at an optimum angle 110 to efficiently field the ball object 502. The fielding aid equipment (e.g., fielding aid accessory 100) may enforce the wrist and the palm section 202 of the forearm 200 in an open state to enable appropriate fielding of the ball object 502, according to one embodiment.

In a further embodiment, a method of wearing a fielding aid accessory 100 to securely affix a fielding glove 300 on a forearm 200 of an athlete 500 include positioning the fingers of the athlete 500 through a space of a retaining element 108 of the fielding aid accessory 100. The method of wearing the fielding aid accessory 100 to securely affix the fielding glove 300 on the forearm 200 of the athlete 500 include extending the second extension strap 106 through the center opening 304 of the fielding glove 300. The method of wearing the fielding aid accessory 100 to securely affix the fielding glove 300 on the forearm 200 of the athlete 500 include fastening a second hook strap (e.g., hook fastener 106A) of the second extension strap 106 to a second loop strap (e.g., loop fastener 106B) of the rectangular arcuate panel 102.

In addition, the second hook strap (e.g., hook fastener 106A) and the second loop strap (e.g., loop fastener 106B) wraps around a wrist strap 306 of the fielding glove 300 to secure the fielding glove 300 with the fielding aid accessory 100. The method of wearing the fielding aid accessory 100 to securely affix the fielding glove 300 on the forearm 200 of the athlete 500 include fastening a first hook strap 104A to wrappably attach with the first loop strap 104B to secure the fielding aid accessory 100 on the forearm 200 of the athlete 500. The method of the fielding aid accessory 100 may further include creating a muscle memory in the forearm 200 of the athlete 500 by restraining the fielding glove 300 from contracting, according to one embodiment.

FIG. 1A is a top perspective view 150A of a fielding aid accessory 100 illustrating a first loop strap 104A, a first hook strap 104B and a second extension strap 106 of a rectangular arcuate panel 102 for securing the rectangular arcuate panel 102 onto a forearm 200 of an athlete 500 to securely affix a fielding glove 300, according to one embodiment. Particularly, FIG. 1A illustrates a fielding aid accessory 100, a rectangular arcuate panel 102, a first loop strap 104A, a first hook strap 104B, a second extension strap 106, a hook fastener 106A, a loop fastener 106B, a retaining element 108, a first surface 122, a first end 124 and a second end 128, according to one embodiment.

The fielding aid accessory 100 may be a training apparatus for the athlete 500 to help learning an appropriate body posture to efficiently field the ball object 502. The fielding aid accessory 100 may be secured onto the forearm 200 of the athlete 500. The fielding aid accessory 100 may enable the athlete wearing the fielding aid accessory 100 to biomechanically understand the ideal body position to efficiently field the ball object. The fielding aid accessory 100 may enable the athlete 500 to use proper hand, glove and/or wrist position to field the ball object 502. The fielding aid accessory 100 may help the athlete 500 to improve the timing and footwork to field the ball object 502. Further, the fielding aid accessory 100 may create a muscle memory in the forearm 200 of the athlete 500 to consistently be in the appropriate fielding position to field the ball object 502, according to one embodiment.

In another embodiment, the fielding aid accessory 100 may be secured onto the forearm 200 of the athlete 500 to efficiently field the ball object 502 (e.g., racquetball ball, tennis ball, cricket ball etc.). The fielding aid accessory 100 may enable the athlete 500 to hold the fielding aid accessory 100 in a front-facing angle. The fielding aid accessory 100 in the front-facing angle may enable the athlete 500 to encompass the ball object 502 in a palm section 202 of the hand. The fielding aid accessory 100 may restrain the hand of the athlete 500 from contracting. The fielding aid accessory 100 may enable to hit the ball object 502 on the same spot (e.g., palm section 202 of hand) every time to make the transfer process quicker and easier.

In a further embodiment, the fielding aid accessory 100 secured onto the forearm 200 of the athlete 500 may be securely affixed with the fielding glove 300. The fielding aid accessory 100 onto the forearm 200 of the athlete 500 securely affixed with the fielding glove 300 may enable the athlete 500 to hold the fielding aid accessory 100 in a front-facing angle. The fielding aid accessory 100 securely affixed with the fielding glove 300 in the front-facing angle may enable the athlete 500 to encompass the ball object 502 (e.g., softball, baseball etc.) in a mitt section 302 of the fielding glove 300. The fielding aid accessory 100 may restrain the fielding glove 300 from contracting. The fielding aid accessory 100 may enable to hit the ball object 502 on the same spot (e.g., mitt section 302 of fielding glove 300) every time to make the transfer process quicker and easier.

The fielding aid accessory 100 may include the rectangular arcuate panel 102, the first loop strap 104A, the first hook strap 104B, the second extension strap 106, and the retaining element 108. The rectangular arcuate panel 102 may be a rigid assembly of the fielding aid accessory 100 to securely position onto the forearm 200 of the athlete 500. The rectangular arcuate panel 102 may be a rigid frame 112 covered with a protective member 114 (e.g., leather material), according to one embodiment.

The rectangular arcuate panel 102 of the fielding aid accessory 100 may be designed to position the forearm 200 at the optimum angle 110 to efficiently field the ball object 502. The rectangular arcuate panel 102 may include the first loop strap 104A and the first hook strap 104B anchored at a center of a first surface 122 of the rectangular arcuate panel 102 proximate a first end 124 of first surface 122 to secure the fielding aid accessory 100 onto the forearm 200 of the athlete 500, according to one embodiment. When fielding aid accessory 100 is secured onto forearm 200, forearm 200 contacts a second surface 126 of rectangular arcuate panel 102, with second surface 126 being below first surface 122 on an opposite side of first surface 122.

In addition, the rectangular arcuate panel 102 may include the second extension strap 106 anchored to the rectangular arcuate panel 102 at a second end 128 of first surface 122 (or, second surface 126 in FIG. 1B) to securely affix the fielding glove 300 to the rectangular arcuate panel 102. Further, the rectangular arcuate panel 102 may include the loop fastener 106B positioned on an interior body of the rectangular arcuate panel 102 to secure with the hook fastener 106A of the second extension strap 106. The rectangular arcuate panel 102 may include the retaining element 108 anchored at a bottom side of the rectangular arcuate panel 102 to enable the athlete 500 to securely position the fingers to wear the fielding aid accessory 100 onto the forearm 200, according to one embodiment.

The first loop strap 104A and the first hook strap 104B may be the fastening components of the fielding aid accessory 100 to secure the fielding aid accessory 100 onto the forearm 200 of the athlete 500. The first loop strap 104A and the first hook strap 104B may be anchored at the center of first surface 122 of the rectangular arcuate panel 102 proximate first end 124 of first surface 122. The first hook strap 104B may be wrappably attached with the first loop strap 104A to secure the fielding aid accessory 100 onto the forearm 200 of the athlete 500, according to one embodiment. When fielding aid accessory 100 is secured onto forearm 200, forearm 200 contacts a second surface 126 of rectangular arcuate panel 102, with second surface 126 being below first surface 122 on an opposite side of first surface 122.

The second extension strap 106 may be a flexible attachment band to enable the fielding aid accessory 100 to securely affix the fielding glove 300 with the rectangular arcuate panel 102 of the fielding aid accessory 100. The second extension strap 106 may be anchored to the rectangular arcuate panel 102 at a second end 128 of first surface 122 (or, second surface 126). The second extension strap 106 may extend over and through a center opening 304 of the fielding glove 300 to securely affix the fielding glove 300 to the rectangular arcuate panel 102. The second extension strap 106 may wrap around a wrist strap 306 of the fielding glove 300 to securely affix the fielding glove 300 to the rectangular arcuate panel 102, according to one embodiment. The second extension strap 106 may be conformably coupled across first surface 122 of rectangular arcuate panel 102 without wrapping thereof around any element external (e.g., fielding glove 300) to fielding aid accessory 100 based on extending second extension strap 106 over first surface 122, according to another embodiment. These two configurations may interchangeably constitute the first and second modes of operation of fielding aid accessory 100.

The second extension strap 106 may include the hook fastener 106A and the loop fastener. The hook fastener 106A and the loop fastener 106B may be the fastening components of the second extension strap 106 to enable the fielding aid accessory 100 to securely affix the fielding glove 300 with the rectangular arcuate panel 102 of the fielding aid accessory 100. The hook fastener 106A of the second extension strap 106 may be secured with the loop fastener 106B positioned on the interior body of the rectangular arcuate panel 102, according to one embodiment.

The retaining element 108 may be a flexible strap anchored at both the ends to enable the athlete 500 to securely position the fingers of the athlete 500. The retaining element 108 may be an elastic cord. The retaining element 108 may be anchored at the bottom side of the rectangular arcuate panel 102. The retaining element 108 may have a space to enable the athlete 500 to securely position the fingers inside the retaining element 108. The retaining element 108 may encompass the fingers when the fielding glove 300 is securely affixed to the rectangular arcuate panel 102, according to one embodiment.

Figure 1B:
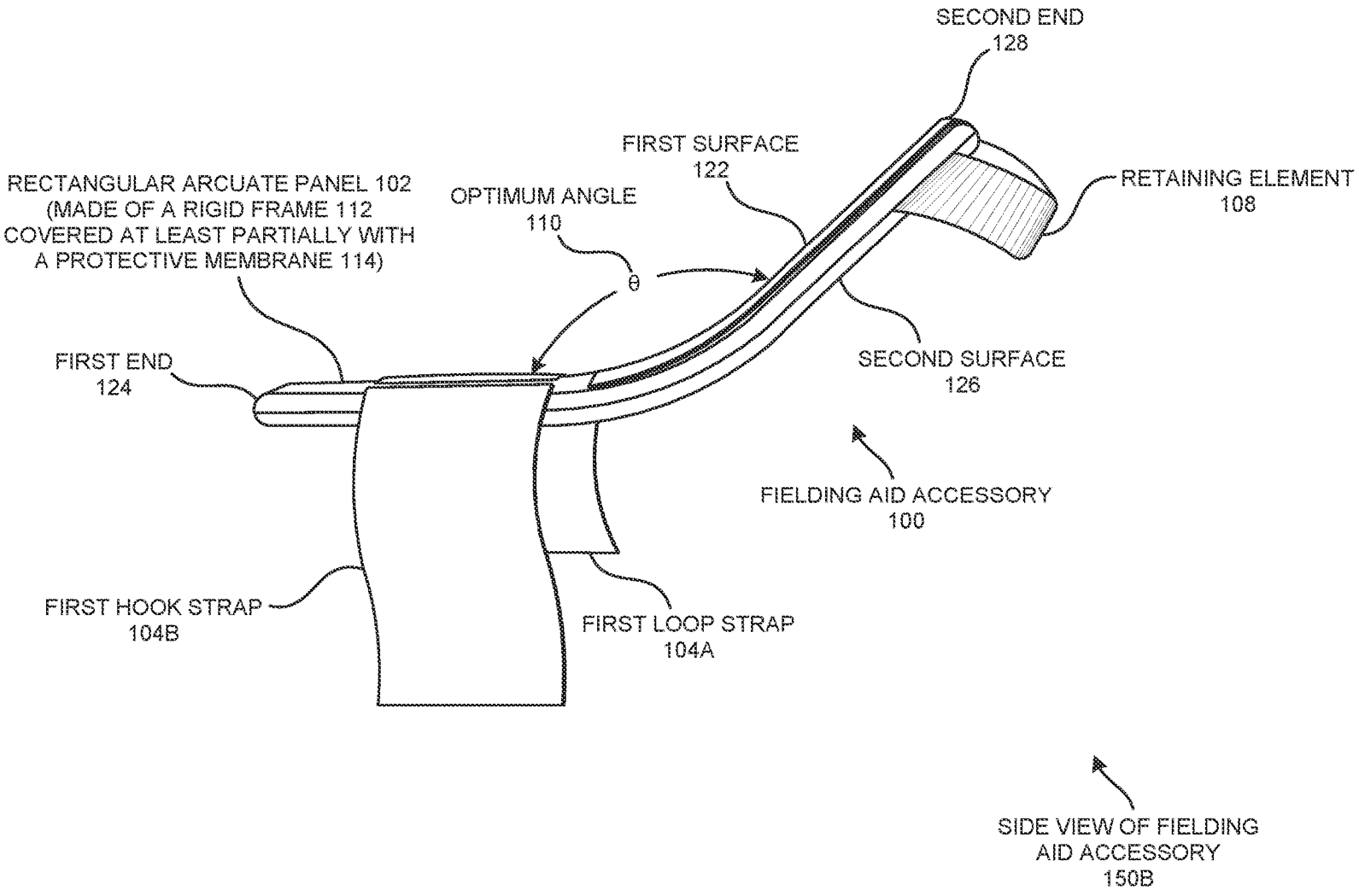
FIG. 1B is a side view of the fielding aid accessory of FIG. 1A illustrating an optimum angle of the rectangular arcuate panel for proper positioning of hand to field the ball object, according to one or more embodiments.

FIG. 1B is a side view 150B of the fielding aid accessory 100 of FIG. 1A illustrating an optimum angle 110 of the rectangular arcuate panel 102 for proper positioning of hand to field the ball object 502, according to one embodiment. Particularly, FIG. 1B illustrates an optimum angle 110 and a second surface 126 of rectangular arcuate panel 102, according to one embodiment.

The optimum angle 110 may be an inclination of the rectangular arcuate panel 102 designed to enable proper hand, glove (e.g., fielding glove 300) and/or wrist position of the athlete 500 wearing the fielding aid accessory 100 to efficiently field the ball object 502. The optimum angle 110 of the rectangular arcuate panel 102 may enable to position the forearm 200 of the athlete 500 to efficiently field the ball object 502. The optimum angle 110 of the rectangular arcuate panel 102 may be approximately 130 to 140 degrees, according to one embodiment.

Figure 2A:
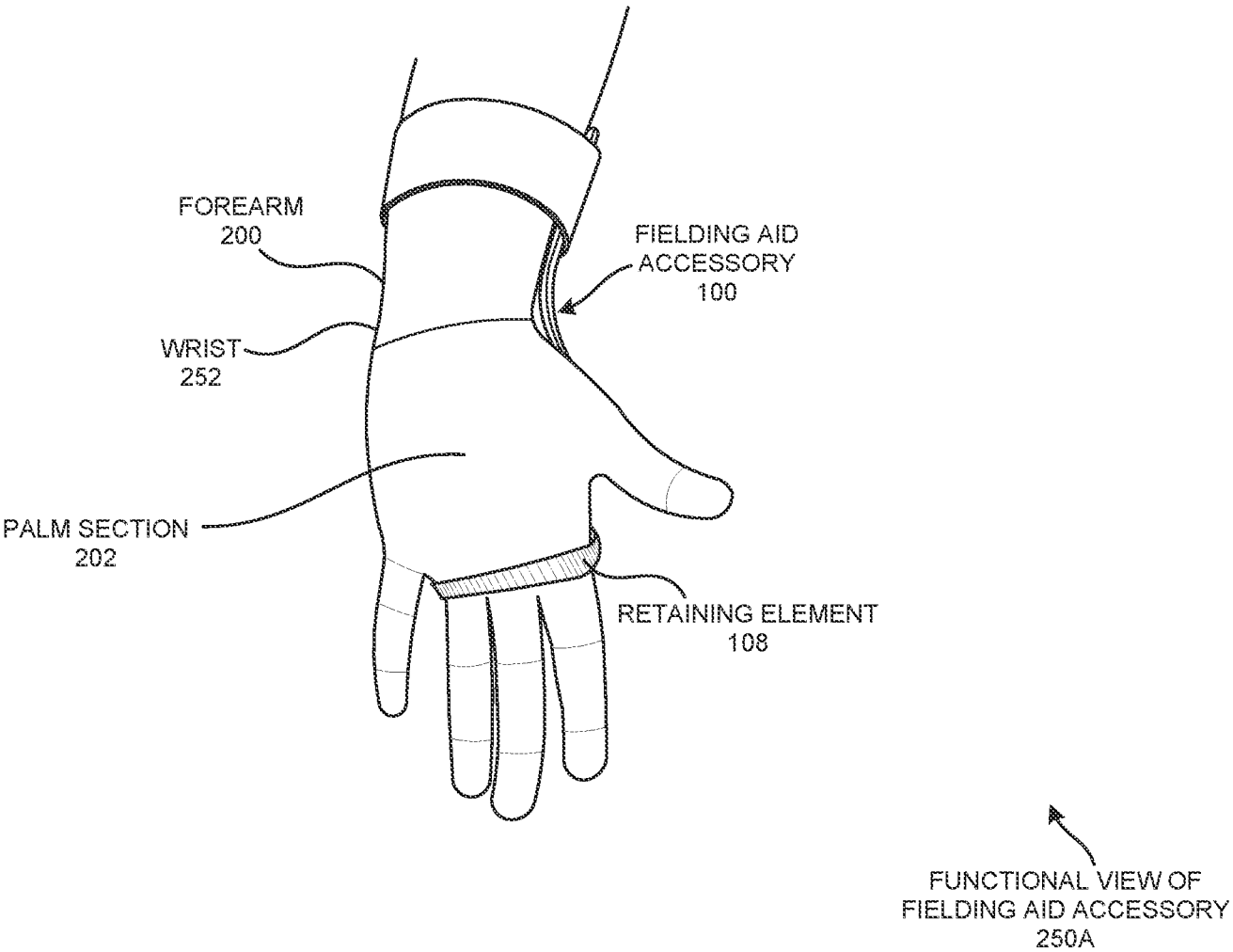
FIG. 2A is a functional view of the fielding aid accessory of FIG. 1A secured onto the forearm of the athlete to enable the retaining element of the rectangular arcuate panel for insertion of fingers, according to one or more embodiments.

FIG. 2A is a functional view 250A of the fielding aid accessory 100 of FIG. 1A secured onto the forearm 200 of the athlete 500 to enable the retaining element 108 of the rectangular arcuate panel 102 for insertion of fingers, according to one embodiment. Particularly, FIG. 2A illustrates a forearm 200 and a palm section 202, according to one embodiment.

The fingers of the hand may be securely positioned inside the retaining element 108 and first hook strap 104B wrappably attached with the first loop strap 104A to secure the fielding aid accessory 100 onto the forearm 200 of the athlete 500. The fielding aid accessory 100 may be firmly secured onto the forearm 200 of the athlete 500 to position the forearm 200 at the optimum angle 110 to efficiently field the ball object 502. The design of the fielding aid accessory 100 may enforce the wrist (e.g., wrist 252) and the palm section 202 of the forearm 200 in an open state to enable appropriate fielding of the ball object 502, according to one embodiment. As seen in FIGS. 2A, 2B, 3A, 4, 5A and 5B, the hand portion (e.g., including palm section 202) of athlete 500 may be at optimum angle 110 to forearm 200 associated therewith about wrist 252 thereof.

The palm section 202 may be extended open through extension of fingers of the hand of the athlete 500 to create more room for the ball object 502 when the fielding aid accessory 100 is secured onto the forearm 200 of the athlete 500. The palm section 202 may be restrained from contracting when the fielding aid accessory 100 is secured onto the forearm 200 of the athlete 500. The athlete 500 wearing the fielding aid accessory 100 may encompass the ball object 502 in the palm section 202 of the hand. The fielding aid accessory 100 may enable to hit the ball object 502 on the same spot (e.g., palm section 202 of hand) every time to make the transfer process quicker and easier, according to one embodiment.

FIG. 2A shows the fielding aid accessory 100 secured onto the forearm 200 of the athlete 500 when the fingers of the athlete 500 are securely positioned inside the retaining element 108 and the first hook strap 104B is wrappably attached with the first loop strap 104A. The fielding aid accessory 100 is firmly secured onto the forearm 200 of the athlete 500 to position the forearm 200 at the optimum angle 110. The palm section 202 is extended open to create room to efficiently field the ball object 502. The optimum angle 110 of the wrist and extended open palm section 202 enable hitting the ball object 502 on the same spot (e.g., palm section 202 of hand) every time to make the transfer process quicker and easier, according to one embodiment.

Figure 2B:
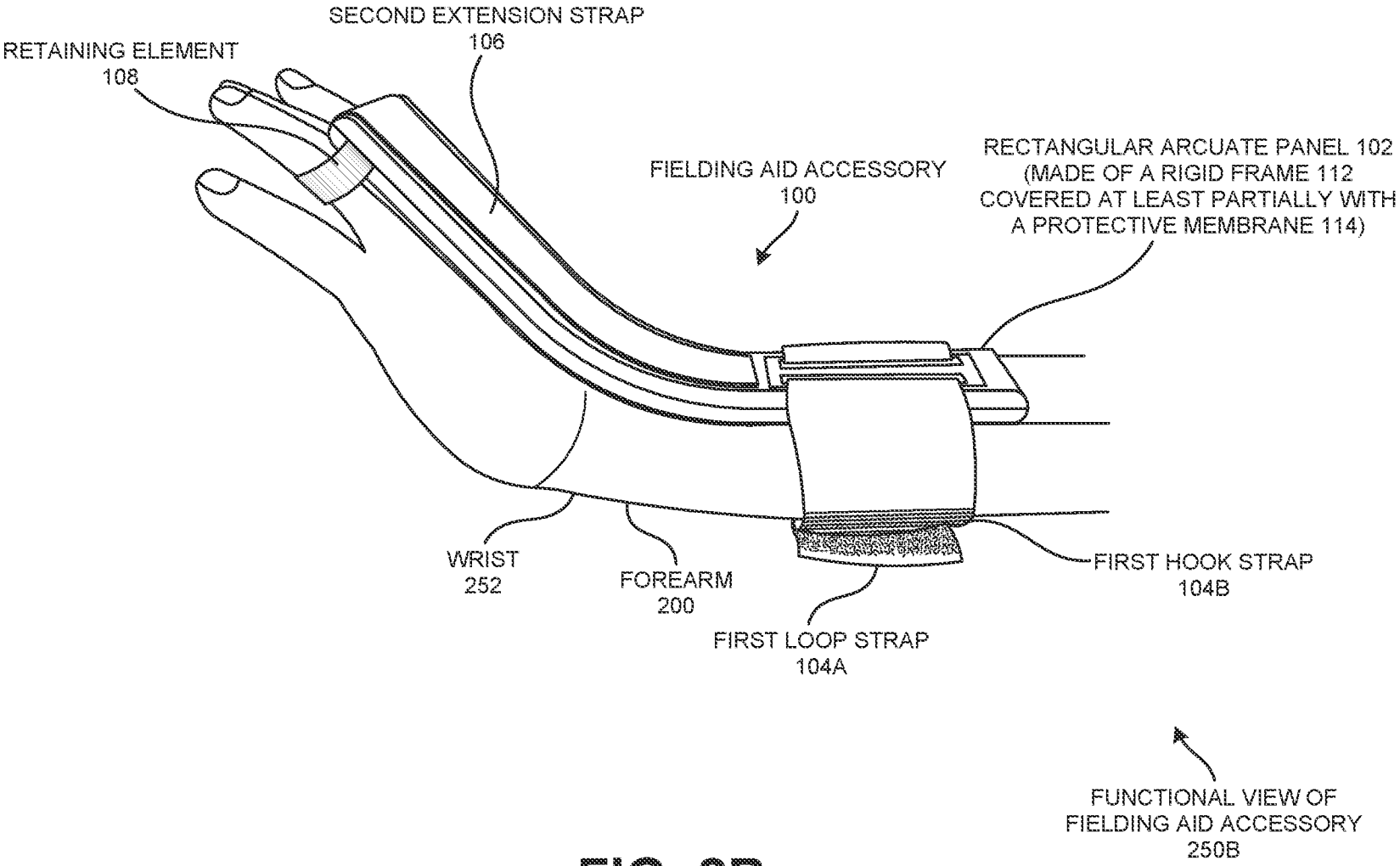
FIG. 2B is another functional view of the fielding aid accessory of FIG. 1A secured onto the forearm of the athlete to position the athlete's hand aligned with the optimum angle of the rectangular arcuate panel, according to one or more embodiments.

FIG. 2B is another functional view 250B of the fielding aid accessory 100 of FIG. 1A secured onto the forearm 200 of the athlete 500 to position the athlete's 500 hand aligned with the optimum angle 110 of the rectangular arcuate panel 102, according to one embodiment.

FIG. 2B shows the fielding aid accessory 100 secured onto the forearm 200 of the athlete 500 when the fingers of the athlete 500 are securely positioned inside the retaining element 108 and the first hook strap 104B is wrappably attached with the first loop strap 104A. The design of the rectangular arcuate panel 102 positions the forearm 200 of the athlete 500 at the optimum angle 110. Further, FIG. 2B shows the hook fastener 106A of the second extension strap 106 is directly secured with the loop fastener 106B when the athlete 500 is fielding the ball object 502 without attaching the fielding glove 300, according to one embodiment.

Figure 3A:
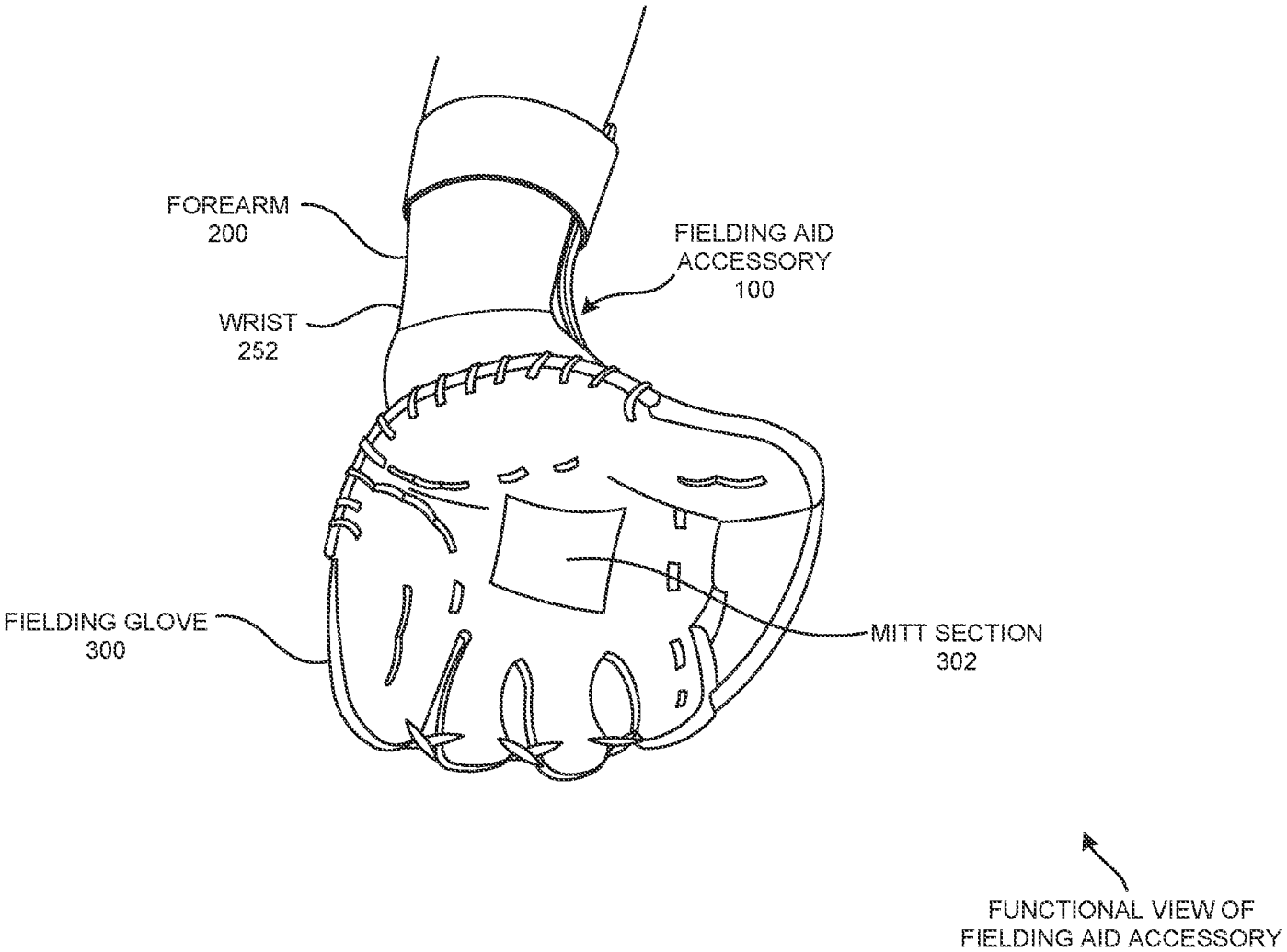
FIG. 3A is a functional view of the fielding aid accessory of FIG. 1A secured onto the forearm of the athlete to securely affix a fielding glove, according to one or more embodiments.

FIG. 3A is a functional view 350A of the fielding aid accessory 100 of FIG. 1A secured onto the forearm 200 of the athlete 500 to securely affix a fielding glove 300, according to one embodiment. Particularly, FIG. 3A illustrates a fielding glove 300, and a mitt section 302, according to one embodiment.

The fielding glove 300 may be a padded protective covering for the hand of the athlete 500 to assist in catching and/or fielding the ball object 502. The fielding glove 300 may be securely affixed to the rectangular arcuate panel 102 when the second extension strap 106 is extended through the center opening 304 and attached with the loop fastener 106B. The fielding glove 300 may be restrained from contracting when the fielding aid accessory 100 is securely affixed with the fielding glove 300, according to one embodiment.

The fielding glove 300 may be extended open through extension of fingers of a hand of the athlete 500 to create more room for the ball object 502 when the ball object 502 is thrown to the athlete 500. The fielding glove 300 may be in a proper presentation to position the hand of the athlete 500 at the optimum angle 110 to efficiently field the ball object 502 due to the design of the rectangular arcuate panel 102, according to one embodiment.

The mitt section 302 may be extended open to create more room for the ball object 502 when the fielding aid accessory 100 is securely affixed with the fielding glove 300. The mitt section 302 may be restrained from contracting when the fielding aid accessory 100 is securely affixed with the fielding glove 300. The athlete 500 wearing the fielding glove 300 securely affixed with the fielding aid accessory 100 may encompass the ball object 502 in the mitt section 302 of the fielding glove 300. The fielding aid accessory 100 may enable the fielding glove 300 to hit the ball object 502 on the same spot (e.g., mitt section 302) every time to make the transfer process quicker and easier, according to one embodiment.

FIG. 3A shows the fielding glove 300 securely affixed to the rectangular arcuate panel 102 of the fielding aid accessory 100 secured onto the forearm 200 of the athlete 500. The fielding glove 300 securely affixes to the fielding aid accessory 100 to position the forearm 200 at the optimum angle 110. The mitt section 302 of the fielding glove 300 is extended open to create room to efficiently field the ball object 502. The optimum angle 110 of the wrist and extended open mitt section 302 enables the ball object 502 to hit on the same spot (e.g., mitt section 302) every time to make the transfer process quicker and easier, according to one embodiment.

Figure 3B:
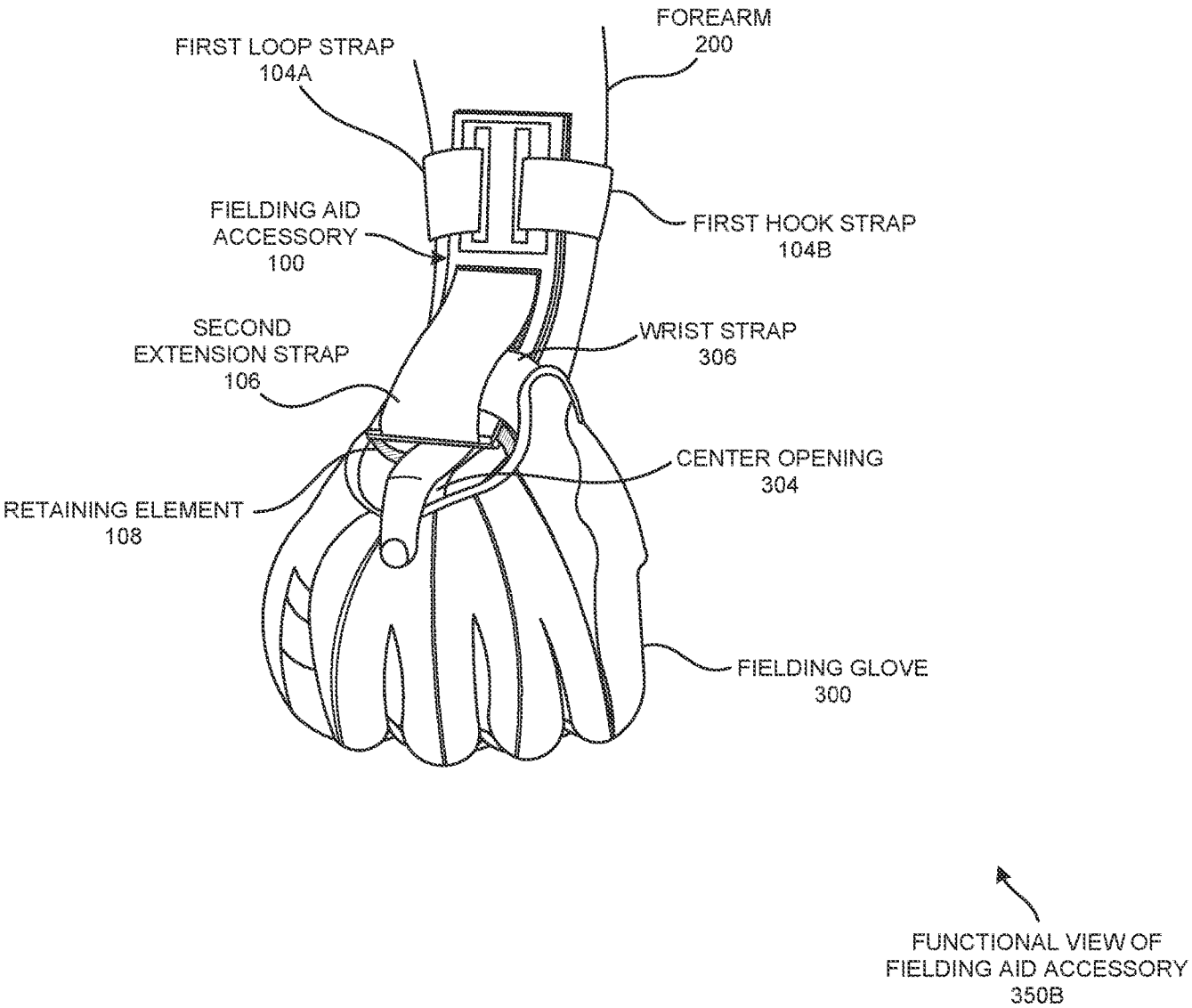
FIG. 3B is another functional view of the fielding aid accessory of FIG. 1A illustrating the second extension strap of the rectangular arcuate panel to secure the fielding glove with the rectangular arcuate panel, according to one or more embodiments.

FIG. 3B is another functional view 350B of the fielding aid accessory 100 of FIG. 1A illustrating the second extension strap 106 of the rectangular arcuate panel 102 to secure the fielding glove 300 with the rectangular arcuate panel 102, according to one embodiment. Particularly, FIG. 3B illustrates a center opening 304, and a wrist strap 306, according to one embodiment.

The center opening 304 of a fielding glove 300 may enable the second extension strap 106 to extend through to securely affix the fielding glove 300 to the rectangular arcuate panel 102. The wrist strap 306 may be a fastening component of the fielding glove 300 to wrappably attach the fielding glove 300 onto the wrist of the athlete 500. The wrist strap 306 may be wrapped around the second extension strap 106 to securely affix the fielding glove 300 to the rectangular arcuate panel 102, according to one embodiment.

FIG. 3B shows the fielding glove 300 securely affixed to the rectangular arcuate panel 102 of the fielding aid accessory 100 secured onto the forearm 200 of the athlete 500. The second extension strap 106 of the rectangular arcuate panel 102 extends over and through the center opening 304 of the fielding glove 300 to securely affix the fielding glove 300 to the rectangular arcuate panel 102. The second extension strap 106 wraps around the wrist strap 306 of the fielding glove 300 to securely affix the fielding glove 300 to the rectangular arcuate panel 102, according to one embodiment.

Figure 4:
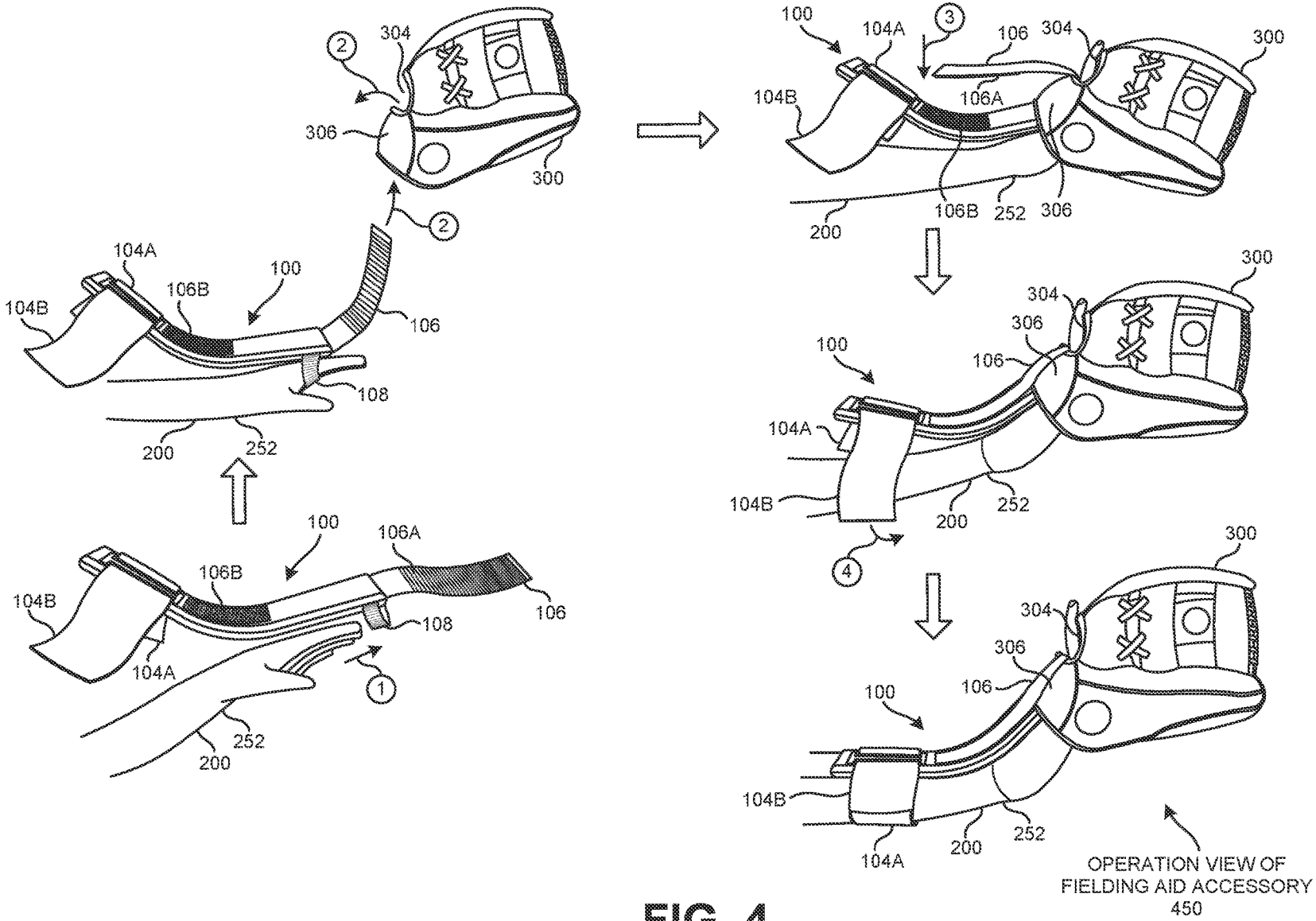
FIG. 4 is an operation view of the fielding aid accessory of FIG. 1A illustrating a sequential procedure of wearing the fielding aid accessory onto the forearm of the athlete to securely affix the fielding glove, according to one embodiment, according to one or more embodiments.

FIG. 4 is an operation view 450 of the fielding aid accessory 100 of FIG. 1A illustrating a sequential procedure of wearing the fielding aid accessory 100 onto the forearm 200 of the athlete 500 to securely affix the fielding glove 300, according to one embodiment.

FIG. 4 illustrates the number of operations between the forearm 200 of the athlete 500, the fielding aid accessory 100 and the fielding glove 300. Particularly, circle '1' of FIG. 4 illustrates the fingers of the athlete 500 being inserted through the retaining element 108 of the fielding aid accessory 100 to position the fielding aid accessory 100 onto the forearm 200 of the athlete 500. The circle '2' shows the second extension strap 106 of the fielding aid accessory 100 being extended through the center opening 304 of the fielding glove 300, according to one embodiment.

The circle '3' shows the hook fastener 106A of the second extension strap 106 being secured with the loop fastener 106B of the second extension strap 106 to the securely affix the fielding glove 300 to the rectangular arcuate panel 102 of the fielding aid accessory 100. The circle '4' shows the first hook strap 104B being wrappably attached with the first loop strap 104A to secure the fielding aid accessory 100 onto the forearm 200 of the athlete 500, according to one embodiment.

Figure 5A:
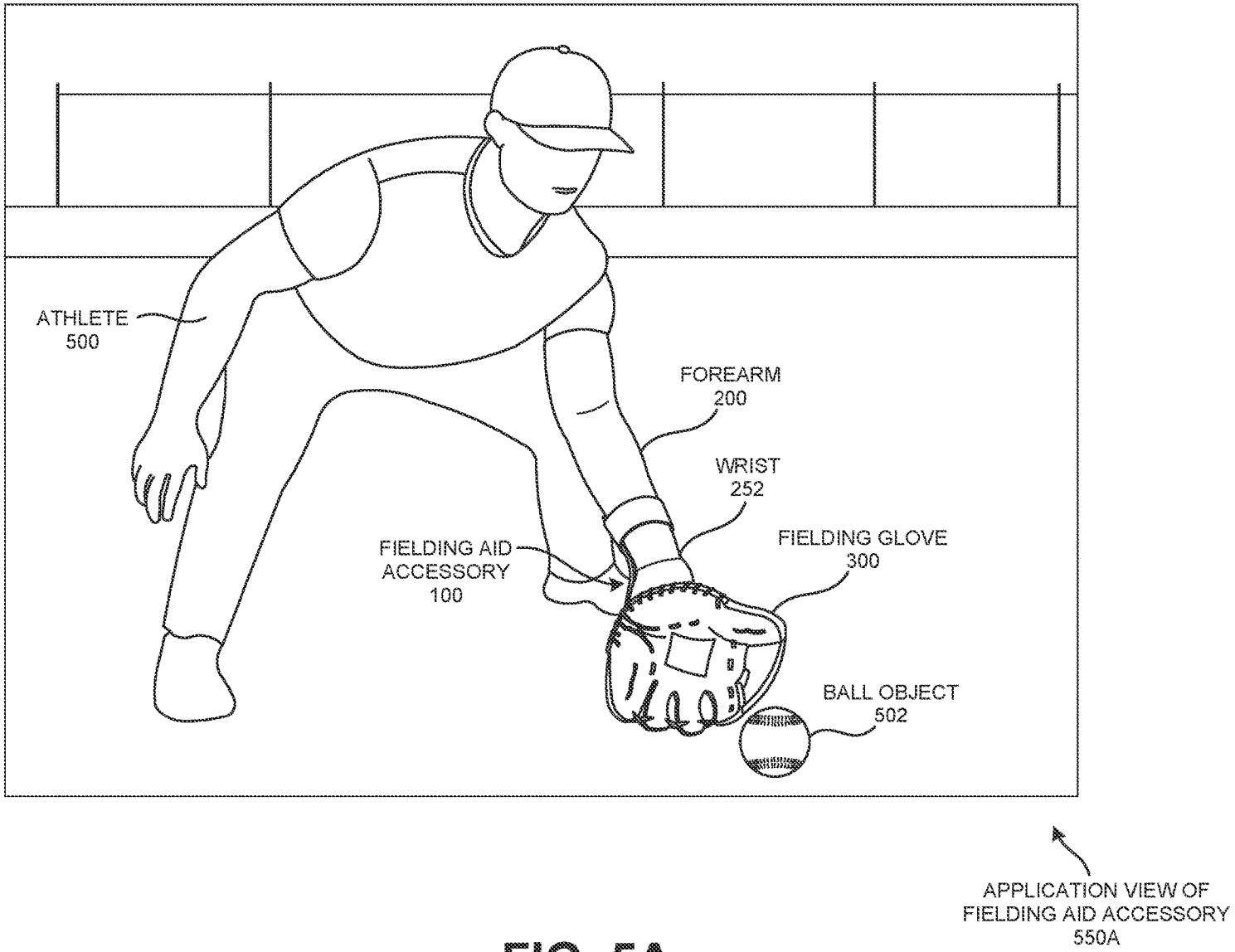
FIG. 5A is an application view of the fielding aid accessory of FIG. 1A secured onto the forearm and the fielding glove of the athlete to field the ground ball, according to one or more embodiments.

FIG. 5A is an application view 550A of the fielding aid accessory 100 of FIG. 1A secured onto the forearm 200 and the fielding glove 300 of the athlete 500 to field a ground ball (e.g., ball object 502), according to one embodiment. Particularly, FIG. 5A illustrates an athlete 500, and a ball object 502, according to one embodiment.

The athlete 500 may be a fielder who wishes to be in a desired fielding posture to efficiently field the ball object 502. The athlete 500 may securely position the fingers through the retaining element 108 of the rectangular arcuate panel 102 and wrappably attach the first strap (e.g., first hook strap 104B and first loop strap 104A) to secure the fielding aid accessory 100 onto the forearm 200 of the athlete 500. The athlete 500 may securely affix the fielding aid accessory 100 with the fielding glove 300, according to one embodiment.

The athlete 500 wearing the fielding aid accessory 100 may have an appropriate fielding posture to efficiently field the ball object 502. The athlete 500 may hold the fielding aid accessory 100 in the front-facing angle to enable the mitt section 302 of the fielding glove 300 and/or the palm section 202 of the hand to encompass the ball object 502. The athlete 500 may field the ball object 502 in the mitt section 302 of the fielding glove 300 and/or the palm section 202 of the hand when the ball object 502 is thrown to the athlete 500, according to one embodiment.

The athlete 500 may be able to field the ground ball, the backhand ball, and/or the forehand ball when the fielding aid accessory 100 is secured onto the forearm 200 and securely affixed with the fielding glove 300. The ball object 502 may be efficiently fielded by the athlete 500 in the appropriate fielding posture. The ball object 502 may be a racquetball ball, a tennis ball, cricket ball, a softball, a, baseball etc. The ball object 502 may be encompassed in the mitt section 302 of the fielding glove 300 and/or the palm section 202 of the hand, according to one embodiment.

FIG. 5A shows the athlete 500 wearing the fielding aid accessory 100 (secured onto the forearm 200 of the athlete 500) securely affix to the fielding glove 300. The fielding aid accessory 100 secured onto the forearm 200 of the athlete 500 enables the athlete 500 to be in the proper fielding posture to efficiently field the ground ball (e.g., ball object 502), according to one embodiment.

The fielding aid accessory 100 may enable the athlete 500 to position the hand, glove and/or wrist at the optimum angle 110 to field the ground ball (e.g., ball object 502). The mitt section 302 of the fielding glove 300 is extended open to create room to efficiently field the ground ball (e.g., ball object 502). The optimum angle 110 of the wrist and extended open mitt section 302 enables the ball object 502 to hit on the same spot (e.g., mitt section 302) every time, according to one embodiment.

Figure 5B:
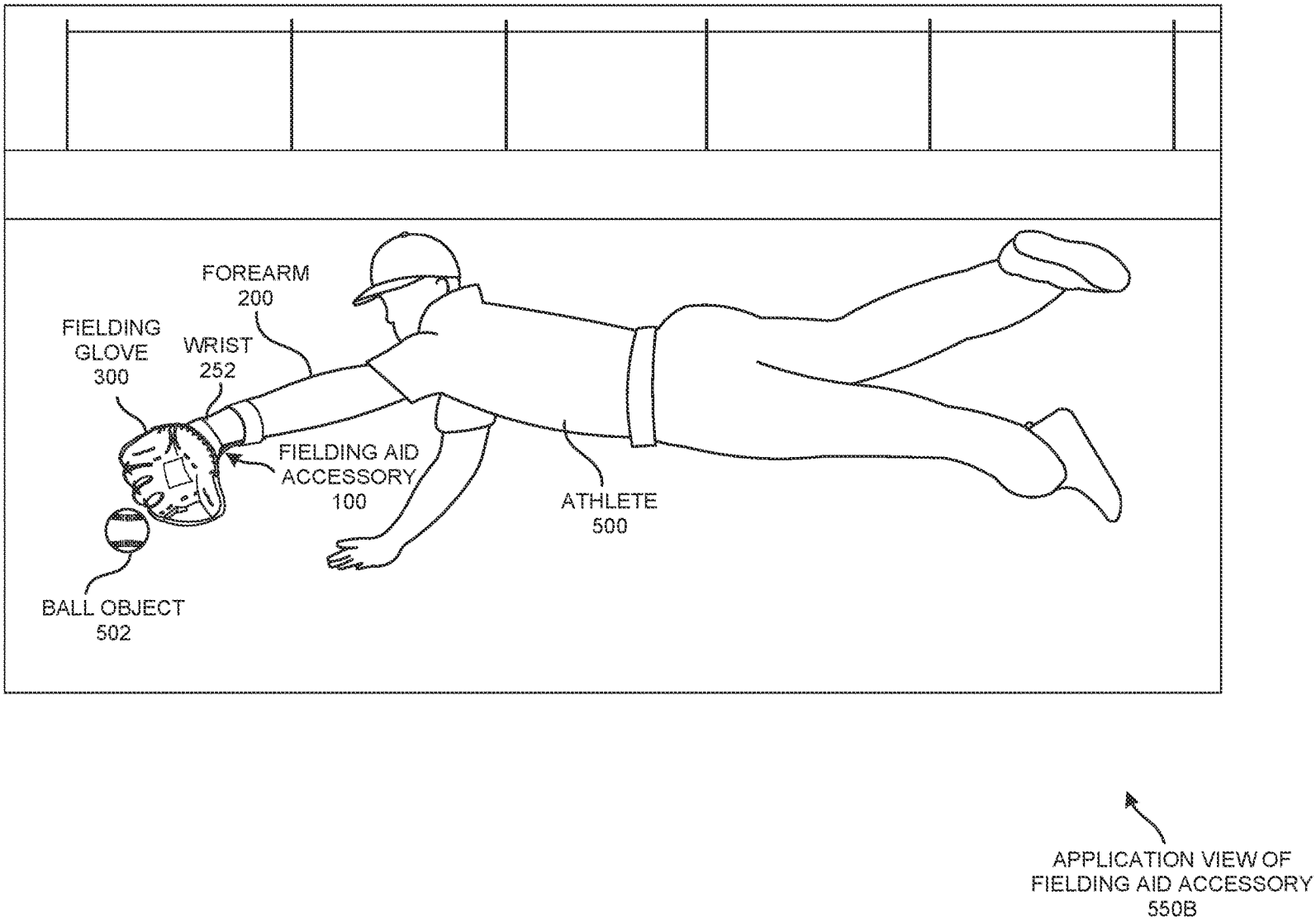
FIG. 5B is another application view of the fielding aid accessory of FIG. 1A secured onto the forearm and the fielding glove of the athlete to field the backhand ball, according to one or more embodiments.

FIG. 5B is another application view 550B of the fielding aid accessory 100 of FIG. 1A secured onto the forearm 200 and the fielding glove 300 of the athlete 500 to field the backhand ball (e.g., ball object 502), according to one embodiment.

FIG. 5B shows the athlete 500 wearing the fielding aid accessory 100 (secured onto the forearm 200 of the athlete 500) securely affix to the fielding glove 300. The fielding aid accessory 100 secured onto the forearm 200 of the athlete 500 enables the athlete 500 to efficiently field the backhand ball (e.g., ball object 502). The fielding aid accessory 100 may enable the athlete 500 to position the hand, glove and/or wrist at the optimum angle 110 to field the backhand ball (e.g., ball object 502). The fielding aid accessory 100 secured onto the forearm 200 of the athlete 500 restrains the mitt section 302 of the fielding glove 300 from contracting and extends open to create room to efficiently field the backhand ball (e.g., ball object 502), according to one embodiment.

An example embodiment will now be described. John Doe may be working as a trainer at ACME Baseball Academy. John may be training all ages of students to develop their baseball skills to become better players. John may be training his students to align themselves in proper body position while fielding baseballs. John may have to spend more time with his students in explaining and/or practicing with them to observe proper positioning of the forearm, wrist, and/or hand to efficiently field and/or catch the ball at different positions. John may be unable to dedicate sufficient time for training his aspiring students in understanding the optimal position to hold their arm and hand position when fielding balls. John may face difficulty while training his students for correct body posture and/or forearm, wrist, and/or hand positioning for efficient fielding and/or catching the ball. Further, it may be difficult for some students to biomechanically understand what it means to be in an ideal body position to field the ball. Fielding and/or catching the ball with wrong body posture may physically harm players. Furthermore, misjudgment of speed and/or direction of the ball while fielding may result in injuries to the students.

To overcome the problem and effectively train students in properly fielding techniques, John may introduce the fielding aid accessory 100 described in various embodiments of FIGS. 1-5 to his students. The student (e.g., athlete 500) may be able to restrain their arm (e.g., forearm 200) position when fielding balls (e.g., ball object 502) to self-realize the biomechanics of proper fielding by physical restraint of arm (e.g., forearm 200) movement by using the fielding aid accessory 100 described in various embodiments of FIGS. 1-5. Therefore, John may save time, improve his success rate with his students, and enable his students to win more games. The students may develop into better players faster and avoid injuries thanks to the fielding aid accessory 100 described in various embodiments of FIGS. 1-5.

The fielding aid accessory 100 described in various embodiments of FIGS. 1-5 may enable the students to be in appropriate body posture to efficiently field the ball (e.g., ball object 502). The fielding aid accessory 100 described in various embodiments of FIGS. 1-5 may enable the students to simultaneously use proper hand, glove (e.g., fielding glove 300) and/or wrist position to field the ball (e.g., ball object 502). The fielding aid accessory 100 described in various embodiments of FIGS. 1-5 may help the students to improve the timing and footwork to field the ball (e.g., ball object 502). In addition, the fielding aid accessory 100 described in various embodiments of FIGS. 1-5 may create a muscle memory in the forearm 200 of the students to consistently be in the appropriate fielding position to field the ball (e.g., ball object 502).

In one or more embodiments, fielding aid accessory 100 may be flexible and resistant enough to allow for a ballistic action with the arm as every ball (e.g., ball object 502) may have a different throw speed and height associated therewith. Again, as discussed above, in one or more embodiments, fielding aid accessory 100 may create an optimum angle 110 related to the fielding position of the body of athlete 500, thereby enabling the body of athlete 500 to follow the angle of the hand thereof. In one or more embodiments, the leather material of protective membrane 114 may provide for comfort to athlete 500. In addition, in one or more embodiments, the leather material may add to the durability of fielding aid accessory 100; the leather material may be beat up in environmental conditions including but not limited to dirt and bad weather, but rigid frame 112 may be intact.

In one or more embodiments, fielding aid accessory 100 may improve consistency of athlete 500 (e.g., a player) with regard to fielding ground balls. In one or more embodiments, fielding aid accessory 100 may serve multiple purposes: fielding aid accessory 100 may attach to fielding glove 300, and also attach to the hand of athlete 500 for bare-hand drills. Thus, in one or more embodiments, fielding aid accessory 100 may be used both for practice (e.g., based on utilizing fielding glove 300) and drill work (e.g., the hand/arm/forearm 200). In one or more embodiments, fielding aid accessory 100 may be made as flexible (e.g., rigidity may be eased) as needed for a specific player (e.g., athlete 500).

As discussed above, fielding aid accessory 100 may be employed during multiple sporting activities including but not limited to baseball and softball. In preferential embodiments related to baseball and softball, fielding aid accessory 100 may aid in creating a correct angle for palm section 202 of athlete 500 to be ballistic and flexible to field ground balls at a consistent rate. In one or more embodiments, as discussed above, retaining element 108 may be an elastic strap; said elastic strap may useful during bare-hand functions of athlete 500. Baseball and softball players may require good hand-eye coordination and quick but smooth hands to absorb ball object 502 having spin and velocity. In one or more embodiments, retaining element 108 may enable an athlete (e.g., athlete 500) to put the requisite amount (and number) of fingers of the hand thereof for appropriate comfort. The elastic strap may not necessarily hold the hand of athlete 500 in a set place; the elastic strap may enable fielding aid accessory 100 to not lose function(s) thereof.

In one or more embodiments, second extension strap 106 may strap around fielding glove 300; preferentially, the coupling of second extension strap 106 back to rectangular arcuate panel 102 after strapping around fielding glove 300 may be Velcro® based. Once strapped, in one or more embodiments, fielding aid accessory 100 may be stable enough for athlete 500 to understand the correct hand posture to field a ground ball object 502. In one or more embodiments, athlete 500 strapping first loop strap 104A around forearm 200 over first hook strap 104B firmly may force a stronger hold and loosely may provide for less of a hold. In one or more embodiments, the aforementioned strapping may provide athlete 500 with flexibility to resist, which is needed to transfer ball object 502 to throwing hand thereof. In one or more embodiments, the aforementioned strapping may be employed both when fielding aid accessory 100 is used with bare-hand work and with fielding glove 300.

Redirecting ball object 502 may be very important for infielders to finish plays. The angle of palm section 202 may need to stay in position in order to redirect ball object 502 such that ball object 502 bounces softly right toward the throwing hand. In one or more embodiments, the above-mentioned strapping may be key to athlete 500 achieving consistency in plays based on better muscle memory.

It should be noted that, in one or more embodiments, as seen in FIGS. 1A, 2B and 3B, a width of second extension strap 106 may clearly be at least 70% (can be easily measured with a scale in original FIG. 3B, for example) of the width of first surface 122 of rectangular arcuate panel 102. In one implementation, said width of second extension strap 106 may be 80% or 90% of the width of first surface 122. This high relative width provides for more strength of the coupling between second extension strap 106 and first surface 122. All reasonable variations are within the scope of the exemplary embodiments discussed herein.

Figure 6:
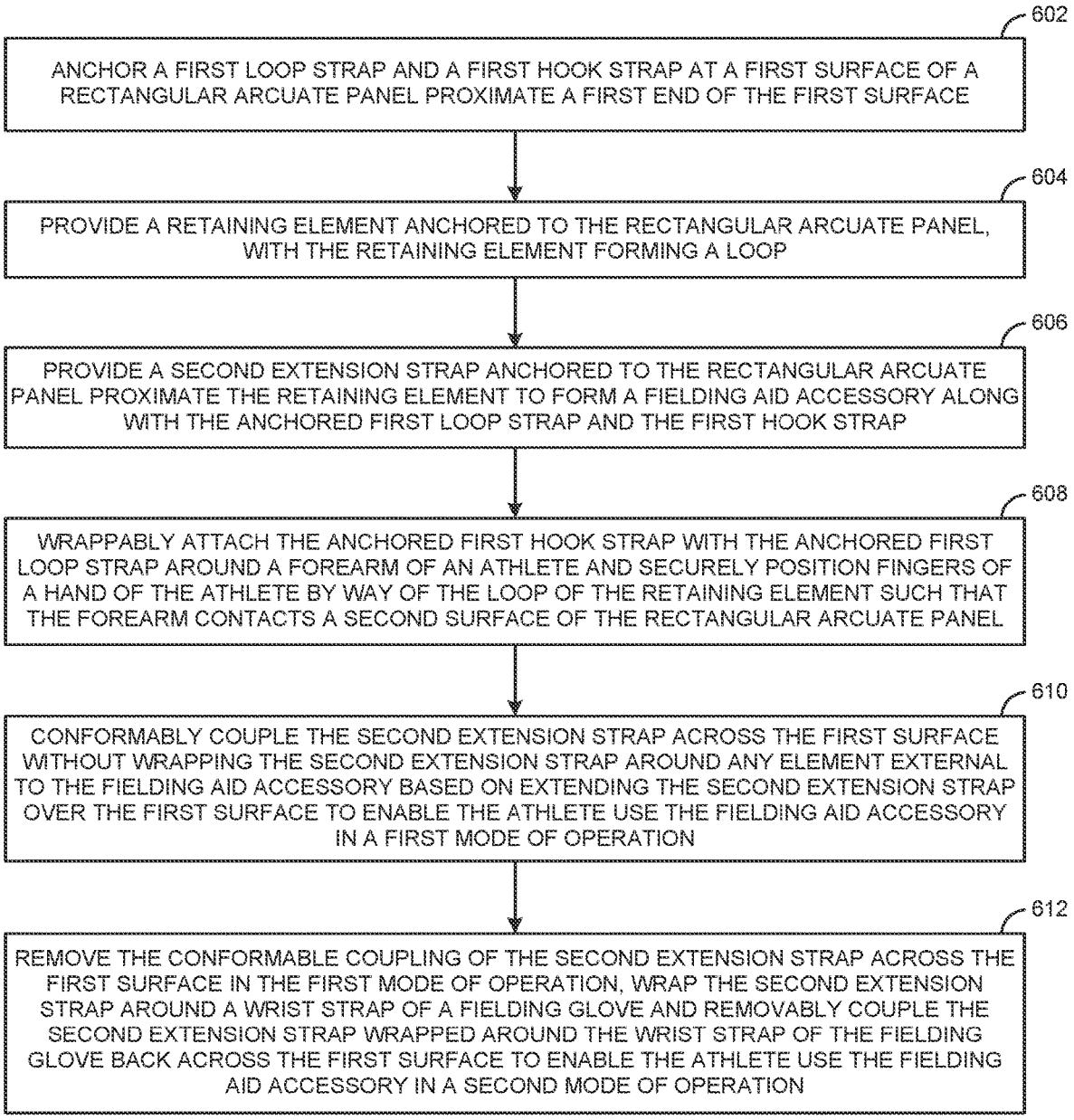
FIG. 6 is a process flow diagram detailing the operations involved in realizing a multi-operative fielding aid accessory, according to one or more embodiments.

FIG. 6 shows a process flow diagram detailing the operations involved in realizing a multi-operative fielding aid accessory (e.g., fielding aid accessory 100), according to one or more embodiments. In one or more embodiments, operation 602 may involve anchoring a first loop strap (e.g., first loop strap 104A) and a first hook strap (e.g., first hook strap 104B) at a first surface (e.g., first surface 122) of a rectangular arcuate panel (e.g., rectangular arcuate panel 102) proximate a first end (e.g., first end 124) of the first surface. In one or more embodiments, operation 604 may involve providing a retaining element (e.g., retaining element 108) anchored to the rectangular arcuate panel. In one or more embodiments, the retaining element may form a loop. In one or more embodiments, operation 606 may involve providing a second extension strap (e.g., second extension strap 106) anchored to the rectangular arcuate panel proximate the retaining element to form the multi-operative fielding aid accessory along with the anchored first loop strap and the first hook strap.

In one or more embodiments, operation 608 may involve wrappably attaching the anchored first hook strap with the anchored first loop strap around a forearm (e.g., forearm 200) of an athlete (e.g., forearm 200) and securely positioning fingers of a hand of the athlete by way of the loop of the retaining element such that the forearm contacts a second surface (e.g., second surface 126) of the rectangular arcuate panel. In one or more embodiments, the second surface may be below the first surface of the rectangular arcuate panel on an opposite side of the first surface. In one or more embodiments, operation 610 may involve conformably coupling the second extension strap across the first surface without wrapping the second extension strap around any element external to the fielding aid accessory based on extending the second extension strap over the first surface to enable the athlete use the fielding aid accessory in a first mode of operation (e.g., drills).

In one or more embodiments, operation 612 may then involve removing the conformable coupling of the second extension strap across the first surface in the first mode of operation followed by wrapping the second extension strap around a wrist strap (e.g., wrist strap 306) of a fielding glove (e.g., fielding glove 300) and removably coupling the second extension strap wrapped around the wrist strap of the fielding glove back across the first surface to enable the athlete use the fielding aid accessory in a second mode of operation. In one or more embodiments, the second mode of operation (e.g., ball game practice) may involve the fielding glove being affixed to the fielding aid accessory by way of the removable coupling. It should be noted that the first mode of operation and the second mode of operation are interchangeable in order, and that a sequential order of operations can involve the second mode of operation followed by the first mode of operation.

Although the present embodiments have been described with reference to specific example embodiments, it will be evident that various modifications and changes may be made to these embodiments without departing from the broader spirit and scope of the various embodiments.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A method comprising:

anchoring a loop strap and a hook strap at a first location on a first surface of a rectangular arcuate panel proximate a first end of the rectangular arcuate panel, the first surface having a first width;

anchoring a retaining element proximate a second end of the rectangular arcuate panel, with the retaining element extending from lateral and opposite edges of the rectangular arcuate panel proximate the second end to form a loop around a second surface of the rectangular arcuate panel, the second surface being below the first surface on an opposite side of the first surface;

anchoring an extension strap to the rectangular arcuate panel at an edge of the rectangular panel proximate the retaining element and perpendicular to the lateral and the opposite edges of the rectangular arcuate panel such that the anchored extension strap, the rectangular arcuate panel, the anchored retaining element, the anchored loop strap and the anchored hook strap form a fielding aid accessory, with the extension strap having a second width thereof equal to at least 70% of the first width of the first surface;

wrappably attaching the anchored hook strap with the anchored loop strap around a forearm of an athlete and securely positioning fingers of a hand of the athlete associated with the forearm by way of the loop of the retaining element such that the forearm contacts the second surface of the rectangular arcuate panel and the retaining element is contactably disposed on a surface of the hand of the athlete that also corresponds to that of a palm section of the hand;

conformably coupling the extension strap across the first surface without wrapping the extension strap around any element external to the fielding aid accessory by extending the extension strap over the first surface to a second location on the first surface proximate the first location of the anchoring of the loop strap and the hook strap to enable the athlete to use the fielding aid accessory in a first mode of operation;

providing the rectangular arcuate panel with an angled shape such that, in the first mode of operation, a portion of the hand of the athlete contacting the rectangular arcuate panel is at an angle about a wrist of the athlete with respect to the forearm thereof contacting the rectangular arcuate panel in conformance with the angled shape; and removing the conformable coupling of the extension strap across the first surface in the first mode of operation followed by wrapping the extension strap around a wrist strap of a fielding glove and removably coupling the extension strap wrapped around the wrist strap of the fielding glove back across the first surface to the second location on the first surface to enable the athlete to use the fielding aid accessory in a second mode of operation, the second mode of operation involving the fielding glove being affixed to the fielding aid accessory by way of the removable coupling.

2. The method of claim 1, comprising providing a flexible attachment band as the extension strap.

3. The method of claim 1, comprising providing a flexible strap as the retaining element.

4. The method of claim 1, comprising wrapping the extension strap around the wrist strap of one of: a baseball glove and a softball glove as the fielding glove.

5. The method of claim 1, comprising providing an elastic cord as the retaining element.

6. The method of claim 1, further comprising providing a rigid frame covered at least partially with a protective membrane as the rectangular arcuate panel.

7. The method of claim 6, comprising providing the rigid frame of the rectangular arcuate panel covered at least partially with leather material as the protective membrane.

8. A method comprising:

anchoring a loop strap and a hook strap at a first location on a first surface of a rectangular arcuate panel proximate a first end of the rectangular arcuate panel, the first surface having a first width, and the rectangular arcuate panel being a rigid frame covered at least partially with a protective membrane;

anchoring a retaining element proximate a second end of the rectangular arcuate panel, with the retaining element extending from lateral and opposite edges of the rectangular arcuate panel proximate the second end to form a loop around a second surface of the rectangular arcuate panel, the second surface being below the first surface on an opposite side of the first surface;

anchoring an extension strap to the rectangular arcuate panel at an edge of the rectangular panel proximate the retaining element and perpendicular to the lateral and the opposite edges of the rectangular arcuate panel such that the anchored extension strap, the rectangular arcuate panel, the anchored retaining element, the anchored loop strap and the anchored hook strap form a fielding aid accessory, with the extension strap having a second width thereof equal to at least 70% of the first width of the first surface;

wrappably attaching the anchored hook strap with the anchored loop strap around a forearm of an athlete and securely positioning fingers of a hand of the athlete associated with the forearm by way of the loop of the retaining element such that the forearm contacts the second surface of the rectangular arcuate panel and the retaining element is contactably disposed on a surface of the hand of the athlete that also corresponds to that of a palm section of the hand;

conformably coupling the extension strap across the first surface without wrapping the extension strap around any element external to the fielding aid accessory by extending the extension strap over the first surface to a second location on the first surface proximate the first location of the anchoring of the loop strap and the hook strap to enable the athlete to use the fielding aid accessory in a first mode of operation;

providing the rectangular arcuate panel with an angled shape such that, in the first mode of operation, a portion of the hand of the athlete contacting the rectangular arcuate panel is at an angle about a wrist of the athlete with respect to the forearm thereof contacting the rectangular arcuate panel in conformance with the angled shape; and removing the conformable coupling of the extension strap across the first surface in the first mode of operation followed by wrapping the extension strap around a wrist strap of a fielding glove and removably coupling the extension strap wrapped around the wrist strap of the fielding glove back across the first surface to the second location on the first surface to enable the athlete to use the fielding aid accessory in a second mode of operation, the second mode of operation involving the fielding glove being affixed to the fielding aid accessory by way of the removable coupling.

9. The method of claim 8, comprising providing a flexible attachment band as the extension strap.

10. The method of claim 8, comprising providing a flexible strap as the retaining element.

11. The method of claim 8, comprising wrapping the extension strap around the wrist strap of one of: a baseball glove and a softball glove as the fielding glove.

12. The method of claim 8, comprising providing an elastic cord as the retaining element.

13. The method of claim 8, comprising providing the rigid frame of the rectangular arcuate panel covered at least partially with leather material as the protective membrane.

14. A method comprising:

forming a fielding aid accessory by:

anchoring a loop strap and a hook strap at a first location on a first surface of a rectangular arcuate panel proximate a first end of the rectangular arcuate panel, the first surface having a first width;

anchoring a retaining element proximate a second end of the rectangular arcuate panel, with the retaining element extending from lateral and opposite edges of the rectangular arcuate panel proximate the second end to form a loop around a second surface of the rectangular arcuate panel, the second surface being below the first surface on an opposite side of the first surface; and anchoring an extension strap to the rectangular arcuate panel at an edge of the rectangular panel proximate the retaining element and perpendicular to the lateral and the opposite edges of the rectangular arcuate panel, with the extension strap having a second width thereof equal to at least 70% of the first width of the first surface;

wrappably attaching the anchored hook strap with the anchored loop strap around a forearm of an athlete and securely positioning fingers of a hand of the athlete associated with the forearm by way of the loop of the retaining element such that the forearm contacts the second surface of the rectangular arcuate panel and the retaining element is contactably disposed on a surface of the hand of the athlete that also corresponds to that of a palm section of the hand;

by the athlete, utilizing the formed fielding aid accessory in a first mode of operation by conformably coupling the extension strap across the first surface without wrapping the extension strap around any element external to the fielding aid accessory by extending the extension strap over the first surface to a second location on the first surface proximate the first location of the anchoring of the loop strap and the hook strap;

providing the rectangular arcuate panel with an angled shape such that, in the first mode of operation, a portion of the hand of the athlete contacting the rectangular arcuate panel is at an angle about a wrist of the athlete with respect to the forearm thereof contacting the rectangular arcuate panel in conformance with the angled shape; and by the athlete, utilizing the formed fielding aid accessory in a second mode of operation by:

wrapping the extension strap around a wrist strap of a fielding glove; and removably coupling the extension strap wrapped around the wrist strap of the fielding glove back across the first surface to the second location on the first surface, the second mode of operation involving the fielding glove being affixed to the fielding aid accessory by way of the removable coupling.

15. The method of claim 14, comprising providing a flexible attachment band as the extension strap.

16. The method of claim 14, comprising providing a flexible strap as the retaining element.

17. The method of claim 14, comprising wrapping the extension strap around the wrist strap of one of: a baseball glove and a softball glove as the fielding glove.

18. The method of claim 14, comprising providing an elastic cord as the retaining element.

19. The method of claim 14, further comprising providing a rigid frame covered at least partially with a protective membrane as the rectangular arcuate panel.

20. The method of claim 15, comprising providing the rigid frame of the rectangular arcuate panel covered at least partially with leather material as the protective membrane.

* * * * *